US011132959B2

(12) United States Patent
Lee

(10) Patent No.: US 11,132,959 B2
(45) Date of Patent: Sep. 28, 2021

(54) ELECTRONIC DEVICE AND CONTROL METHOD THEREOF

(71) Applicant: SAMSUNG ELECTRONICS CO., LTD., Suwon-si (KR)

(72) Inventor: Gyu-heon Lee, Hwaseong-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/956,062

(22) PCT Filed: Oct. 15, 2018

(86) PCT No.: PCT/KR2018/012081

§ 371 (c)(1),
(2) Date: Jun. 19, 2020

(87) PCT Pub. No.: WO2019/139226

PCT Pub. Date: Jul. 18, 2019

(65) Prior Publication Data

US 2021/0020114 A1 Jan. 21, 2021

(30) Foreign Application Priority Data

Jan. 10, 2018 (KR) ..... 10-2018-0003302

(51) Int. Cl.
*G09G 3/34* (2006.01)

(52) U.S. Cl.
CPC ..... *G09G 3/342* (2013.01); *G09G 2320/0626* (2013.01)

(58) Field of Classification Search
CPC ..... G09G 3/36; G09G 3/20; G09G 3/3406; G09G 3/3208; G09G 3/3426;
(Continued)

(56) References Cited

U.S. PATENT DOCUMENTS 8,129,895 B2 3/2012 Kim et al.
8,378,959 B2 2/2013 Yeo et al.
(Continued)

FOREIGN PATENT DOCUMENTS

JP 2013-37015 A 2/2013
KR 10-0868531 B1 11/2008
(Continued)

OTHER PUBLICATIONS

International Search Report (PCT/ISA/210) dated Jan. 23, 2019 by the International Searching Authority in counterpart International Patent Application No. PCT/KR2018/012081.
(Continued)

*Primary Examiner* — Olga V Merkoulova
(74) *Attorney, Agent, or Firm* — Sughrue Mion, PLLC

(57) ABSTRACT

An electronic device is disclosed. The electronic device comprises an input unit, and a processor for acquiring a current duty of each first dimming block for driving a backlight unit, on the basis of pixel information of an image input through the input unit, identifying at least one second dimming block including at least one first dimming block in the input image on the basis of the pixel information of the input image, acquiring a current value of the second dimming value on the basis of a current duty of the first dimming block included in the identified second dimming block, and acquiring a driving signal for driving the backlight unit, on the basis of the current duty of each first dimming block and the current value of the second dimming block.

15 Claims, 18 Drawing Sheets

(58) Field of Classification Search
CPC ..... G09G 2320/0646; G09G 3/3648; G09G 2300/0426; G09G 2330/021; G09G 2354/00; G09G 5/10; G09G 2360/144
See application file for complete search history.

(56) References Cited

U.S. PATENT DOCUMENTS 8,552,967 B2 * 10/2013 Nakanishi ..... G09G 3/3406 345/102
8,963,826 B2 2/2015 Oda et al.
9,870,740 B2 1/2018 Park et al.
10,366,662 B2 7/2019 An et al.
2006/0022921 A1 * 2/2006 Miyake ..... G09G 3/3406 345/87
2006/0175986 A1 * 8/2006 Lee ..... H05B 45/20 315/312
2007/0046619 A1 * 3/2007 Sano ..... G09G 3/3406 345/102
2007/0063957 A1 * 3/2007 Awakura ..... G02F 1/13318 345/98
2007/0188439 A1 * 8/2007 Kimura ..... G09G 3/3406 345/102
2007/0229452 A1 * 10/2007 Sano ..... G02F 1/136209 345/102
2007/0268241 A1 * 11/2007 Nitta ..... G09G 3/3406 345/102
2010/0007589 A1 * 1/2010 Yeo ..... G09G 3/3426 345/83
2011/0279749 A1 11/2011 Erinjippurath et al.
2016/0037015 A1 * 2/2016 Mizuno ..... H04N 1/00244 358/1.14
2016/0055799 A1 * 2/2016 Eom ..... G09G 3/3225 345/690
2017/0110065 A1 * 4/2017 Zhang ..... G09G 3/2018
2017/0116928 A1 * 4/2017 Kim ..... G02F 1/1368
2018/0018522 A1 * 1/2018 Litvak ..... G06K 9/00711
2018/0182306 A1 * 6/2018 Seong ..... G09G 3/3648

FOREIGN PATENT DOCUMENTS

KR 10-1213898 B1 12/2012
KR 10-1451310 B1 10/2014
KR 10-1542367 B1 8/2015
KR 10-2016-0032758 A 3/2016
KR 10-2017-0026024 A 3/2017
KR 10-2017-0109437 A 9/2017

OTHER PUBLICATIONS

Written Opinion (PCT/ISA/237) dated Jan. 23, 2019 by the International Searching Authority in counterpart International Patent Application No. PCT/KR2018/012081.

* cited by examiner

ELECTRONIC DEVICE AND CONTROL METHOD THEREOF

CROSS-REFERENCE TO RELATED APPLICATIONS

This application is a National Phase Entry of PCT International Application No. PCT/KR2018/012081, which was filed on Oct. 15, 2018, and claims priority to Korean Patent Application No. 10-2018-0003302, which was filed Jan. 10, 2018, the disclosure of which is incorporated herein by reference.

TECHNICAL FIELD

The present application relates to an electronic device and a control method thereof, and more particularly to an electronic device that provides a driving signal for driving a backlight unit, and a control method thereof.

BACKGROUND ART

A display panel made of an element that does not emit light by itself, for example, a liquid crystal display (LCD) panel, must have a backlight in a display module in order to realize an image. When the backlight is activated, for example, CCFL-based LCD TV of a 46-inch consumes a total of 240W of power. Even when it is not necessary to activate the backlight, such as in a dark scene, it always 100% runs, and as the power increases, the temperature of the backlight and display module also increases. This can affect LCD characteristics due to an excessive thermal gradient of heat emitted by the backlight. For this reason, a brightness of the backlight, that is, the power consumption is limited as much as possible.

As a method for reducing power consumption of a backlight, backlight dimming is most widely used. The backlight dimming can be divided into local dimming, which divides a screen into a plurality of areas and individually controls the backlight luminance by each area, and global dimming, which collectively lowers the backlight luminance of the entire screen.

However, global backlight dimming, which collectively lowers the backlight luminance of the entire screen, has a problem in that a contrast ratio of an image cannot be clearly expressed.

DETAILED DESCRIPTION OF THE INVENTION

Technical Problem

The present disclosure is in accordance with the above-described needs, and a technical problem of the present application is to provide an electronic device capable of improving the contrast ratio of an input image by additionally controlling a current value based on a current duty for local dimming, and a control method thereof.

Technical Solution

An aspect of the embodiments relates to an electronic device including an input unit, and a processor for acquiring a current duty of each first dimming block for driving a backlight unit, on the basis of pixel information of an image input through the input unit, identifying at least one second dimming block including at least one first dimming block in the input image on the basis of the pixel information of the input image, acquiring a current value of the second dimming value on the basis of a current duty of the first dimming block included in the identified second dimming block, and acquiring a driving signal for driving the backlight unit, on the basis of the current duty of each first dimming block and the current value of the second dimming block.

The processor may be configured to variably identify at least one of a size and shape of the second dimming block based on the pixel information of the input image.

The processor may be configured to acquire the current value of the second dimming block based on at least one of an average duty value, a maximum duty value, a minimum duty value, and an intermediate duty value of at least one first dimming block included in the second dimming block.

The processor may be configured to acquire a current duty corresponding to the second dimming block by applying a predetermined weight to at least one of the maximum duty value, the minimum duty value, and the intermediate duty value of at least one first dimming block included in the second dimming block, and acquire the current value of the second dimming value based on the acquired current duty.

The electronic device may further include a storage unit for storing information about a current value corresponding to each current duty, wherein the processor is configured to acquire the current value corresponding to the current duty of the first dimming block included in the second dimming block, and acquire the current value of the second dimming block based on the acquired current value.

The processor may be configured to acquire a gain value according to the current duty of the first dimming value included in the second dimming block, and acquire the current value of the second dimming block by applying the acquired gain value to a predetermined current value.

The processor may be configured to identify the input image as a plurality of areas according to grayscale, and identify at least one second dimming block within each area.

The processor may be configured, based on a black area larger than a predetermined size being included in the input image, to identify the second dimming block in the remaining area other than the black area.

The processor may be configured, based on a logo area being included in the input image, to identify the logo area as the second dimming block.

The electronic device may further include a display panel, and a backlight unit, wherein the processor is configured to drive the backlight unit based on the acquired driving signal.

An aspect of the embodiments relates to a control method of an electronic device including acquiring a current duty of each first dimming block for driving a backlight unit based on pixel information of an input image, identifying at least one second dimming block including at least one first dimming block in the input image based on the pixel information of the input image, acquiring a current value of the second dimming block based on the current duty of the first dimming block included in the identified second dimming block, and acquiring a driving signal for driving the backlight unit based on the current duty of the each first dimming block and the current value of the second dimming block.

The identifying the second dimming block may include variably identifying at least one of a size and shape of the second dimming block based on pixel information of the input image.

The acquiring the current value of the second dimming block may include acquiring the current value of the second dimming block based on at least one of an average duty value, a maximum duty value, a minimum duty value, and an intermediate duty value of at least one first dimming block included in the second dimming block.

The acquiring the current value of the second dimming block may include acquiring the current duty corresponding to the second dimming block by applying a predetermined weight to at least one of the maximum duty value, the minimum duty value, and the intermediate duty value of at least one first dimming block included in the second dimming block, and acquiring the current value of the second dimming value based on the acquired current duty.

The acquiring the current value of the second dimming value may include acquiring the current value corresponding to the current duty of the first dimming block included in the second dimming block, and acquiring the current value of the second dimming block based on the acquired current value.

The acquiring the current value of the second dimming value may include acquiring a gain value according to the current duty of the first dimming value included in the second dimming block, and acquiring the current value of the second dimming block by applying the acquired gain value to a predetermined current value.

The identifying the second dimming block may include identifying the input image as a plurality of areas according to grayscale, and identifying at least one second dimming block within each area.

The identifying the second dimming block may include, based on a black area larger than a predetermined size being included in the input image, identifying the second dimming block in the remaining area other than the black area.

The identifying the second dimming block may include, based on a logo area being included in the input image, identifying the logo area as the second dimming block.

The electronic device may further include a display panel, and a backlight unit, wherein the processor is configured to drive the backlight unit based on the acquired driving signal.

When executed by the processor of the electronic device according to an embodiment of the disclosure, as for a non-transitory computer readable medium storing computer instructions for letting the electronic device perform an operation, the operation may include, based on the pixel information of the input image, acquiring a current duty of each first dimming block for driving a backlight unit, on the basis of pixel information of an image input, identifying at least one second dimming block including at least one first dimming block in the input image on the basis of the pixel information of the input image, acquiring a current value of the second dimming value on the basis of a current duty of the first dimming block included in the identified second dimming block, and acquiring a driving signal for driving the backlight unit, on the basis of the current duty of each first dimming block and the current value of the second dimming block.

Effect of the Invention

As described above, according to various embodiments of the present disclosure, the contrast ratio of the input image may be improved, and power consumption may be reduced. In addition, an effect of black improvement may also be improved.

Mode for Implementing the Disclosure

Figure 1A:
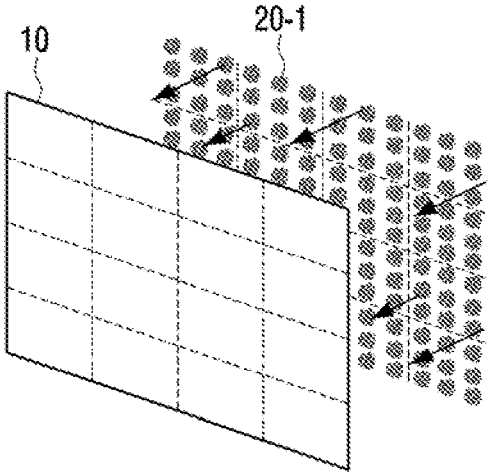
FIGS. 1A and 1B are views illustrating a method of driving a backlight according to an embodiment.

Hereinafter, the present disclosure will be described in detail with reference to the accompanying drawings.

The terms used in example embodiments will be briefly explained, and example embodiments will be described in greater detail with reference to the accompanying drawings.

Terms used in the present disclosure are selected as general terminologies currently widely used in consideration of the configuration and functions of the present disclosure, but can be different depending on intention of those skilled in the art, a precedent, appearance of new technologies, and the like. Further, in specific cases, terms may be arbitrarily selected. In this case, the meaning of the terms will be described in the description of the corresponding embodiments. Accordingly, the terms used in the description should not necessarily be construed as simple names of the terms, but be defined based on meanings of the terms and overall contents of the present disclosure.

The example embodiments may vary, and may be provided in different example embodiments. Various example embodiments will be described with reference to accompanying drawings. However, this does not necessarily limit the scope of the exemplary embodiments to a specific embodiment form. Instead, modifications, equivalents and replacements included in the disclosed concept and technical scope of this specification may be employed. While describing exemplary embodiments, if it is determined that the specific description regarding a known technology obscures the gist of the disclosure, the specific description is omitted.

The terms such as "first," "second," and so on may be used to describe a variety of elements, but the elements should not be limited by these terms. The terms used herein are solely intended to explain specific example embodiments, and not to limit the scope of the present disclosure.

Singular forms are intended to include plural forms unless the context clearly indicates otherwise. The terms "include", "comprise", "is configured to," etc., of the description are used to indicate that there are features, numbers, steps, operations, elements, parts or combination thereof, and they should not exclude the possibilities of combination or addition of one or more features, numbers, steps, operations, elements, parts or a combination thereof.

The expression at least one of A and/or B represents any one of either "A" or "B" or "A and B".

In the present disclosure, a 'module' or a 'unit' performs at least one function or operation and may be implemented by hardware or software or a combination of the hardware and the software. In addition, a plurality of 'modules' or a plurality of 'units' may be integrated into at least one module and may be at least one processor except for 'modules' or 'units' that should be realized in a specific hardware.

The example embodiments of the disclosure will be described in greater detail below in a manner that will be understood by one of ordinary skill in the art. However, exemplary embodiments may be realized in a variety of different configurations, and not limited to descriptions provided herein. Also, well-known functions or constructions are not described in detail since they would obscure the invention with unnecessary detail.

Figure 1B:
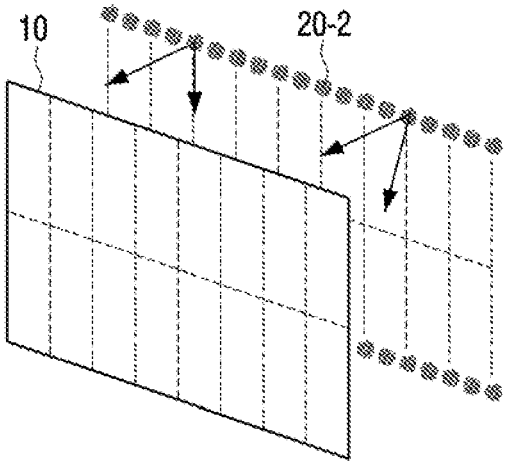

FIGS. 1A and 1B are views illustrating a method of driving a backlight according to an embodiment;

Backlight dimming may be divided into local dimming, which divides a screen into a plurality of areas and individually controls the backlight luminance by each area, and global dimming, which collectively lowers the backlight luminance of the entire screen.

The local dimming may improve static contrast and reduce power consumption by locally controlling the luminance of the screen within one frame period.

*According to an embodiment, the backlight unit providing light to a display panel 10 may be implemented as a direct type backlight unit or an edge backlight unit.

As illustrated in FIG. 1A, the direct type backlight unit 20-1 may be implemented with a structure in which a plurality of optical sheets and a diffusion plate are laminated under the display panel 10 and a plurality of light sources are disposed under a diffusion plate. As for the direct type backlight unit 20-1, it may be divided into a plurality of backlight blocks as illustrated in FIG. 1A based on the arrangement structure of the plurality of light sources. Each of the plurality of backlight blocks may be driven according to a current duty based on pixel information of a corresponding screen area, as illustrated.

As illustrated in FIG. 1B, the edge backlight unit 20-2 may be implemented with a structure in which a plurality of optical sheets and a light guide plate are laminated under the display panel 130 and a plurality of light sources are disposed on side surfaces of the light guide plate.

The edge backlight unit 20-2 may be divided into a plurality of backlight blocks, as illustrated in FIG. 1B, based on the arrangement structure of the plurality of light sources. Each of the plurality of backlight blocks may be driven according to a current duty based on pixel information of a corresponding screen area, as illustrated.

However, since the existing local dimming controls only current duty according to a PWM method, there is a limitation in reducing the brightness of black and low grayscale areas, so there is a problem that it is insufficient to improve a contrast ratio.

Accordingly, various methods of applying backlight dimming to improve visibility of black and low grayscale regions will be described in various embodiments of the disclosure.

Figure 2A:
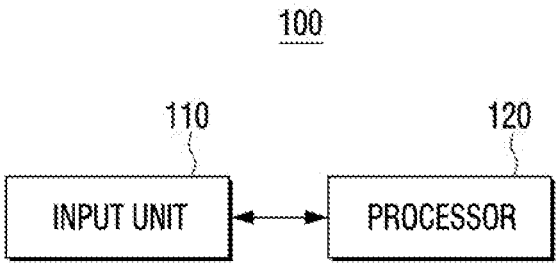
FIGS. 2A and 2B are block diagrams illustrating configuration of an electronic device according to an embodiment.
Figure 2B:
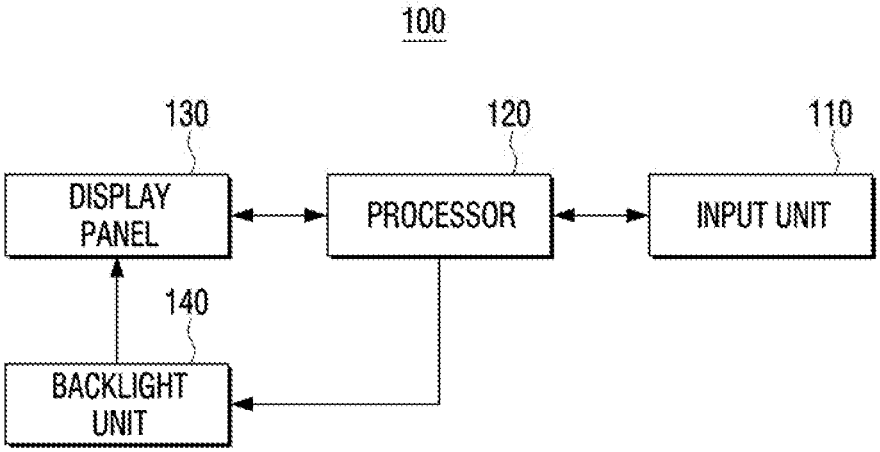

FIGS. 2A and 2B are block diagrams illustrating configuration of an electronic device according to an embodiment.

The electronic device 100 may be implemented as a set-top box that supplies content to an external display device (not illustrated), a server, a workstation, a desktop PC, a laptop PC, and a video providing devices such as a DVD player, smartphones, tablets, a smart TV, an Internet TV, a web TV, an internet protocol television (IPTV), a signage, PC, a smart TV, a monitor, a large format display (LFD), a digital signage (digital Signage), a digital information display (DID), a video wall, a projector display, or the like.

FIG. 2A illustrates that the electronic device 100 is implemented as an image providing device, and FIG. 2B illustrates that the electronic device 100 is implemented as a display device, and configurations, illustrated in FIGS. 2A and 2B, overlapping each other may be cross-applied without a separate description.

Referring to FIG. 2A, the electronic device 100 includes an input unit 110 and a processor 120.

The input unit may receive an image from an external source.

According to an embodiment, the input unit 110 may be implemented in a form that supports at least one communication method among various types of digital interfaces, HDMI interfaces, AP-based Wi-Fi (Wi-Fi, Wireless LAN networks), Bluetooth, Zigbee, wired/wireless local area network (LAN), WAN, Ethernet, IEEE 1394, HDMI, USB, MHL, AES/EBU, Optical, Coaxial, or the like.

In addition, the electronic device 100 may further include a separate communication interface (not illustrated) capable of receiving an image signal in a way of streaming or download method from an external device (e.g., a source device), an external storage medium (e.g., USB), an external server (e.g., web hard) through various communication methods described above.

The processor 120 may control the overall operation of the electronic device 100.

According to an embodiment, the processor 120 may include one or more of a digital signal processor (DSP), a microprocessor, a time controller (TCON), a central processing unit (CPU), and a microcontroller unit (MCU), a micro processing unit (MPU), a controller, application processor (AP), or communication processor (CP), an ARM processor, or may be defined by the corresponding term. In addition, the processor 120 may be implemented with a system on chip (SoC) with a built-in processing algorithm, a large scale integration (LSI), or a field programmable gate array (FPGA).

The processor 120 may generate a signal for adjusting at least one of supply time and intensity of a driving current (or driving voltage) supplied to a backlight unit provided in an external display device (not illustrated).

For example, the processor 120 may generate a signal for controlling luminance of light sources included in the backlight unit with pulse width modulation (PWM) in which a duty ratio is variable. Further, the processor 120 may generate a signal for controlling the luminance of the light sources of the backlight unit by varying the intensity of the current. The pulse width modulated signal (PWM) controls a ratio of turning on and off of the light sources, and the duty ratio % may be determined according to a dimming value input from the processor 120.

The processor 120 acquires a dimming ratio for driving the backlight unit based on pixel information (or pixel physical quantity) of the input image, that is, a lighting duty of a current (hereinafter referred to as current duty). The pixel information may be at least one of an average pixel value of each block area, a maximum pixel value (or peak pixel value), a minimum pixel value, and an intermediate pixel value and an average picture level (APL). In this case, the pixel value may include at least one of luminance value (or grayscale value) and a color coordinate value. Hereinafter, for convenience of description, a case in which APL is used as pixel information will be described.

The processor 120 may acquire a dimming ratio for driving the backlight unit for each section, that is, current duty, based on pixel information for each section of an input image, for example, APL information. A predetermined section may be a frame unit, but is not limited thereto, and it may be a plurality of frame sections, scene sections, and the like. For this operation, the processor 120 may acquire a current duty based on the pixel information based on a predetermined function (or arithmetic algorithm), but the current duty information according to the pixel information may be stored in a form of a lookup table or graph.

For example, the processor 120 may convert pixel data (RGB) for each frame to a luminance level according to a predetermined conversion function, and divide a sum of the luminance levels by a total number of pixels to calculate APL for each frame. However, it is not limited thereto, and various conventional APL calculation methods may be used. The processor 120 may control the current duty as 100% in an image frame where the APL is a predetermined value (e.g., 80%), and may determine a current duty corresponding to each APL value by using a function that reduces the current duty of the image frame having an ALP value of 80% or less to be inversely proportional to the APL value linearly or nonlinearly. However, when the current duty corresponding to the APL value is stored in a lookup table, the current duty may be derived from the lookup table by letting the APL as a lead address.

Meanwhile, the processor 120 may acquire a current duty for driving the backlight unit by local dimming, which identifies a screen as a plurality of areas and individually controls backlight luminance for each area.

For example, the processor 120 may identify the screen as a plurality of screen areas capable of separately controlling current duty according to an implementation form of the backlight unit, and acquire a current duty for respectively driving light source of the backlight unit corresponding to each image area based on pixel information of an image, which will be displayed, of each screen area (hereinafter, referred to as image area), for example APL information. Hereinafter, for convenience of description, the plurality of image areas are designated as a first dimming block, and each backlight area corresponding to the first dimming block is designated as a first backlight block. For example, each first backlight block may include at least one light source, for example, a plurality of light sources.

Figure 3A:
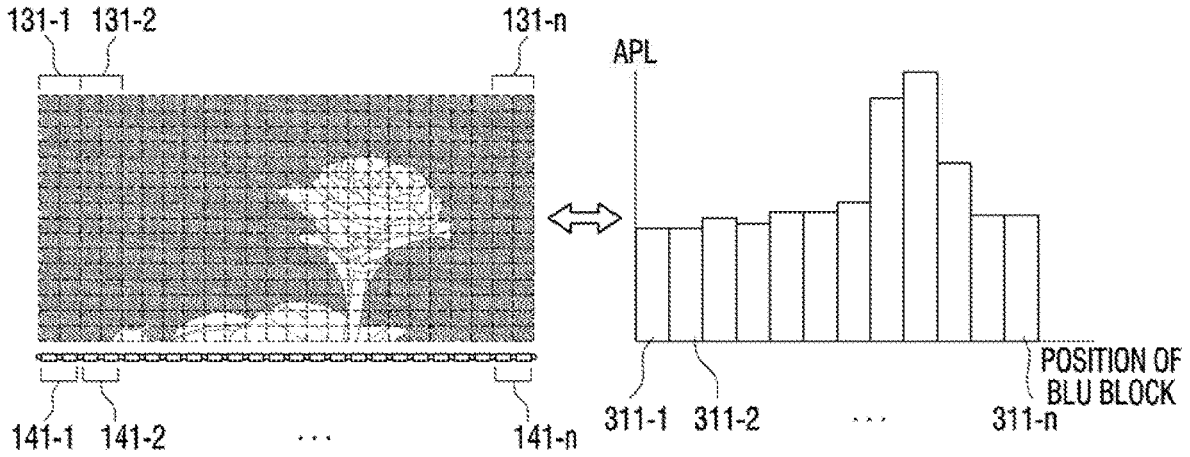
FIGS. 3A and 3B are views illustrating a method of acquiring a current duty corresponding to each first backlight block according to an embodiment.
Figure 3B:
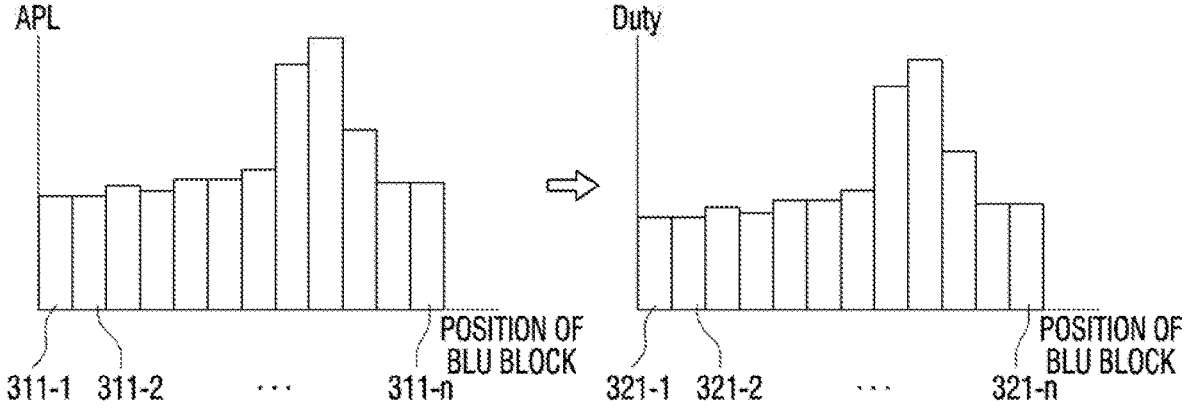

FIGS. 3A and 3B are views illustrating a method of acquiring a current duty corresponding to each first backlight block according to an embodiment. FIGS. 3A and 3B, for convenience of description, the edge backlight unit 20-2 illustrated in FIG. 1B is introduced and described. However, the direct type backlight unit 20-1 may also acquire the current duty in the same way.

When the backlight unit is implemented as the edge backlight unit 20-2 according to an embodiment of the disclosure, the processor 120 may acquire pixel information of an image which will be displayed on the first dimming block corresponding to each first backlight block of the backlight unit 20-2, for example APL information, and calculate a current duty, which will be applied to the first backlight block corresponding to the first dimming block, based on the acquired pixel information.

For example, the processor 120 may calculate an image area corresponding to each of the first backlight blocks 141-1 to **141-*n*, that is APL information of the first dimming blocks 131-1 to 131-*n*, as illustrated on the right side of FIG. 3**A-*n*. For example, the left side of FIG. 3A represents a case of calculating APL values 311-1 to **311-*n* of each image area 131-1 to 131-*n*** according to an embodiment.

As illustrated in FIG. 3B, the processor 120 may calculate current duties 321-1 to **321-*n* corresponding to each of the first backlight blocks 141-1 to 141-*n* corresponding to the first dimming block based on the APL value of each image area. For example, the current duty of the first backlight blocks 141-1 to 141-*n*** may be calculated by applying a predetermined weight to the ALP value of each image area. For example, a current duty of an image area with APL of 10% may be calculated as 10%*6=60%, and a current duty of an image area with APL of 7% may be calculated as 7%*6=42%. However, it is only an example of calculating the current duty, and the current duty may be calculated in various ways based on pixel information of each screen area.

The processor 120 may identify at least one second dimming block including at least one first dimming block in an input image based on the pixel information of the input image, and may acquire a current value of the second dimming block based on the current duty of at least one first dimming block included in the identified second dimming block. In other words, the processor 120 may acquire the second dimming block, that is a current value which will be applied to the second dimming block, based on the current duty of the backlight block corresponding to the at least one first dimming block included in the second dimming block.

Based on the pixel information of the input image, the processor 120 may identify the input image as a plurality of areas, that is, different areas, according to grayscale, and identify at least one grayscale area or at least one second dimming block within each area. For example, the processor 120 may identify the input image as a first grayscale area, a second grayscale area, and a third grayscale area, and may identify at least one second dimming block within each grayscale area. The first to third grayscale areas may be low grayscale area, medium grayscale area, and high grayscale area, but are not limited thereto.

When the input image includes a black area (e.g., 0 to 5 grayscale; hereinafter, a black grayscale area) of a predetermined size or more in the input image, the processor 120 may identify the second dimming block in the remaining areas except the black area.

When a logo area is included in the input image, the processor 120 may identify an area including the logo area as a second dimming block.

The processor 120 may variably identify at least one of the size and shape of the second dimming block for each predetermined content section (e.g., each frame) based on the pixel information of the input image. For example, the second dimming block may be set to various shapes and sizes even within one frame, and the number of second dimming blocks included in the input image may be the same/different for each content section (e.g., frame).

The processor 120 may acquire a current value of the second dimming block based on at least one of an average duty value, a maximum duty value, a minimum duty value, and an intermediate duty value of the at least one first dimming block included in the second dimming block. The pixel value may include at least one of a luminance value (or grayscale value) and a color coordinate value.

According to an embodiment, the processor 120 may acquire a current value of the second dimming block based on information about a current value corresponding to each current duty. The corresponding information may be prestored in the electronic device 100 in the form of a look-up table, or may be acquired from an external device (e.g., an external display device), or an algorithm, an equation, etc.

for calculating a current value corresponding to each current duty may be pre-stored in the electronic device 100 or may be acquired from an external device (e.g., an external display device).

For example, the processor 120 may acquire the current value corresponding to the current duty of the first dimming block included in the identified second dimming block from the information, and may acquire the current value of the second dimming block based on the acquired current value.

For example, when two first dimming blocks are included in the second dimming block, when current duties corresponding to each of the first dimming blocks are 100% and 50%, and 100%, and when current values corresponding to 100% and 50% are 100 mA and 50 mA, respectively, the processor 120 may acquire current values corresponding to a duty value of 75%, which is an average value of the duty values of 100% and 50%, from the information, and the acquired current value may be a current value of the second dimming block. However, it is not limited thereto, and it may also be possible to calculate the current value of the second dimming block in consideration of only the maximum duty of 100% or the minimum duty of 50% of the duty values corresponding to the first dimming block.

Alternatively, the processor 120 may acquire a current value corresponding to the current duty acquired by applying a predetermined weight to the current duty of the first dimming block included in the identified second dimming block, and acquire the current value of the second dimming block based on the acquired current value. In this case, the processor 120 may acquire the duty value corresponding to the second dimming value by applying the predetermined weight to at least one of the maximum duty value, the minimum duty value, and the intermediate duty value of at least one first dimming block included in the second dimming block, and acquire the current value of the second dimming block based on the acquired current duty.

For example, when two first dimming blocks are included in the second dimming block and current duties corresponding to each of the first dimming blocks are 30%, 40%, 50%, the processor 120 may acquire the current duty corresponding to the second dimming block by applying the predetermined weight to at least one of 30% of minimum duty, 40% of intermediate duty and 50% of maximum duty. For example, the current duty corresponding to the second dimming block may be acquired by various methods, such as (3O %+40%+50%)/3, (3O %+40%+(50%*α))/3, ((3O %*β)+40%+50%)/3, ((3O %*β)+40%+(50%*α))/3. The applied weights may be different or the same.

According to another embodiment, the current value of the second dimming block may be acquired based on current gain value information corresponding to each current duty. the corresponding information may be pre-stored in the electronic device 100 in the form of a look-up table, or may be acquired from an external device (e.g., an external display device). Alternatively, an algorithm, an equation, etc. for calculating a current gain value corresponding to each current duty may be pre-stored in the electronic device 100 or may be acquired from an external device (e.g., an external display device).

For example, the processor 120 may acquire a gain value according to the current duty of the first dimming block included in the identified second dimming block from the information, and may apply the obtained gain value to a predetermined current value to acquire the current value of the second dimming block. The predetermined current value may be a current value acquired based on at least one of a first global current value in consideration of power consumption of an external display device and a second global current value in consideration of grayscale characteristics of an input image. The first global current value may be received from the external display device, and the second global current value may be acquired based on the input image.

For example, when two first dimming blocks are included in the second dimming block, when current duties corresponding to each of the first dimming blocks are 100% and 50%, and when current gain values corresponding to 100% and 50% are 1 and 0.6, respectively, the processor 120 may acquire the current gain value corresponding to a duty of 75%, which is an average value of 100% and 50% of the current duty, from the information, and may acquire the current value of the second dimming block by applying the acquired current gain value to at least one of the first global current value and the second global current value. However, it is not limited thereto, and it may also be possible to calculate the current gain value by considering only the maximum duty of 100% or the minimum duty of 50% among the duty values corresponding to the first dimming block.

The processor 120 may generate a driving signal for driving the backlight unit based on the current duty and current value corresponding to each of the first dimming blocks.

The electronic device 100 according to FIG. 2B includes an input unit 110, a processor 120, a display panel 130, and a backlight unit 140. Detailed descriptions of components overlapping with those illustrated in FIG. 2A among components illustrated in FIG. 2B will be omitted.

The display panel 130 includes a plurality of pixels, and each pixel may be formed of a plurality of sub-pixels. For example, each pixel may be composed of a plurality of light, for example, three sub-pixels corresponding to red light, green light, and blue light (R, G, B). However, it is not limited thereto, and in some cases, cyan, magenta, yellow, black, or other subpixels may be included in addition to the red, green, and blue subpixels. The display panel 130 may be implemented as a liquid crystal display panel. However, if backlight dimming according to an embodiment of the disclosure is applicable, it may be implemented as another type of display panel.

The backlight unit 140 may provide the light to the display panel 130.

In particular, the backlight unit 140 irradiates light to the display panel 130 from a rear surface of the display panel 130, that is, an opposite surface of the surface on which the image is displayed.

The backlight unit 140 may include a plurality of light sources, and the plurality of light sources may include, but are not limited to, a linear light source such as a lamp or a point light source such as a light emitting diode. The backlight unit 120 may be implemented as a direct type backlight unit or an edge type backlight unit. A light source of the backlight unit 120 may include any one or two or more types of light sources among a light emitting diode (LED), a hot cathode fluorescent lamp (HCFL), a cold cathode fluorescent lamp (CCFL), an external electrode fluorescent lamp (EEFL), ELP, and FFL.

According to an embodiment, the backlight unit 140 may be implemented with a plurality of LED modules and/or a plurality of LED cabinets. In addition, the LED module may include a plurality of LED pixels, according to an example, the LED pixel may be implemented as an RGB LED, and the RGB LED may include RED LED, GREEN LED, and BLUE LED together.

The processor 130 drives the backlight unit 120 to provide light to the display panel 130. For example, the processor 120 adjusts and outputs at least one of supply time and intensity of a driving current (or driving voltage) supplied to the backlight unit 120. At least one of the supply time and intensity of the driving current (or driving voltage) supplied to the backlight unit 120 may be obtained according to various embodiments as described in FIG. 2A, and detailed description thereof will be omitted.

Meanwhile, the processor 120 may be implemented in a form of including a driver IC for driving the backlight unit 120. For example, the processor 120 may be implemented as a DSP, and may be implemented as a digital driver IC and one chip. However, the driver IC may definitely be implemented with hardware separate from the processor 120. For example, when the light sources included in the backlight unit 120 are implemented as LED elements, the driver IC may be implemented as at least one LED driver that controls a current applied to the LED elements. According to an embodiment, the LED driver may be disposed at a rear end of a power supply (e.g., a switching mode power supply (SMPS)) to receive a voltage from the power supply. However, according to another embodiment, a voltage may be applied from a separate power supply. Alternatively, it is also possible that the SMPS and the LED driver are implemented in the form of an integrated module.

Meanwhile, according to an embodiment, the processor 120 may arrange at least one of a current duty and a current value corresponding to each backlight block according to a connection order of each backlight block, and supply it to a local dimming driver. In this case, the local dimming driver may generate a pulse width modulation (PWM) signal having each current duty provided from the processor 120, and drive sequentially each backlight block based on the generated PWM signal and the corresponding current value. According to another embodiment, the processor 120 may generate the PWM signal based on a calculated current duty and provide it to the local dimming driver.

Figure 4A:
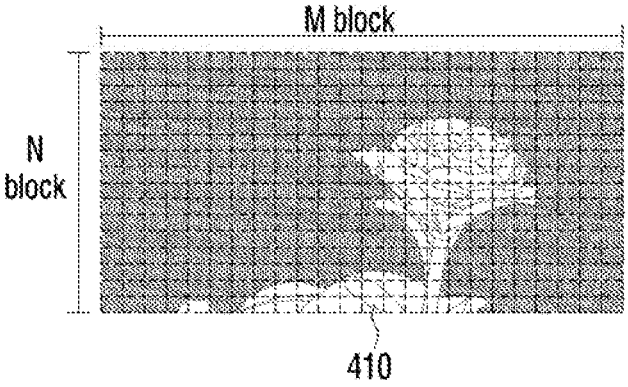
FIGS. 4A and 4B are views illustrating a method of identifying a second dimming block according to an embodiment.
Figure 4B:
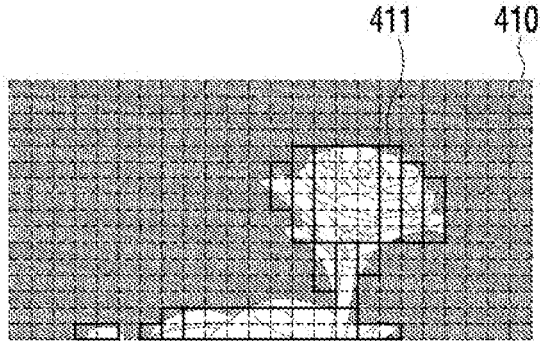

FIGS. 4A and 4B are views illustrating a method of identifying a second dimming block according to an embodiment.

FIG. 4A assumes that the direct type backlight is divided into M*N backlight blocks and is possible to be controlled by PWM duty for each block.

For this operation, as illustrated in FIG. 4A, the input image 410 may be identified as M*N first dimming blocks. In other words, the processor 120 may determine a current duty corresponding to each of the first dimming blocks based on pixel information of each of the M*N first dimming blocks.

As illustrated in FIG. 4B, the processor 120 may identify second dimming blocks 411 having various sizes and shapes including at least one first dimming block based on pixel information of the input image 410.

The processor 120 may acquire a current value to be applied to each of the second dimming blocks based on current duty of the second dimming blocks included in each of the second dimming blocks.

For this operation, the processor 120 may acquire the current value to be applied to each of the second dimming blocks based on at least one of information about a current value corresponding to each current duty and information about a current gain value corresponding to each current duty as described above.

The processor 120 may generate a driving signal for driving the backlight unit based on the current value and current duty corresponding to each of the first dimming blocks.

Figure 5A:
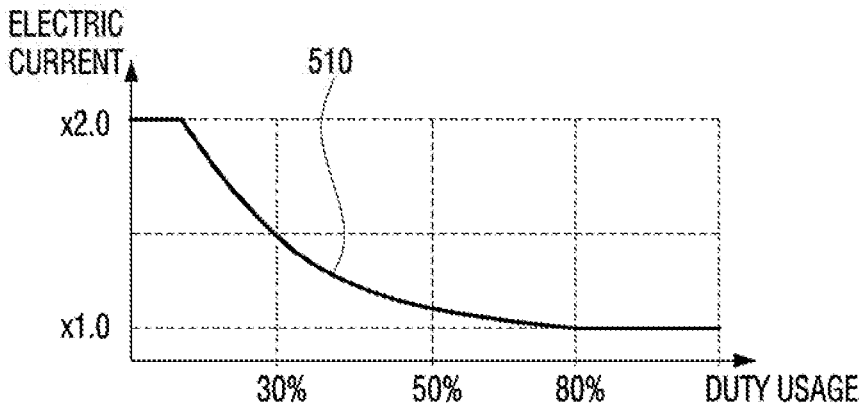
FIGS. 5A to 5C are views illustrating information used to acquire a current value according to an embodiment.
Figure 5B:
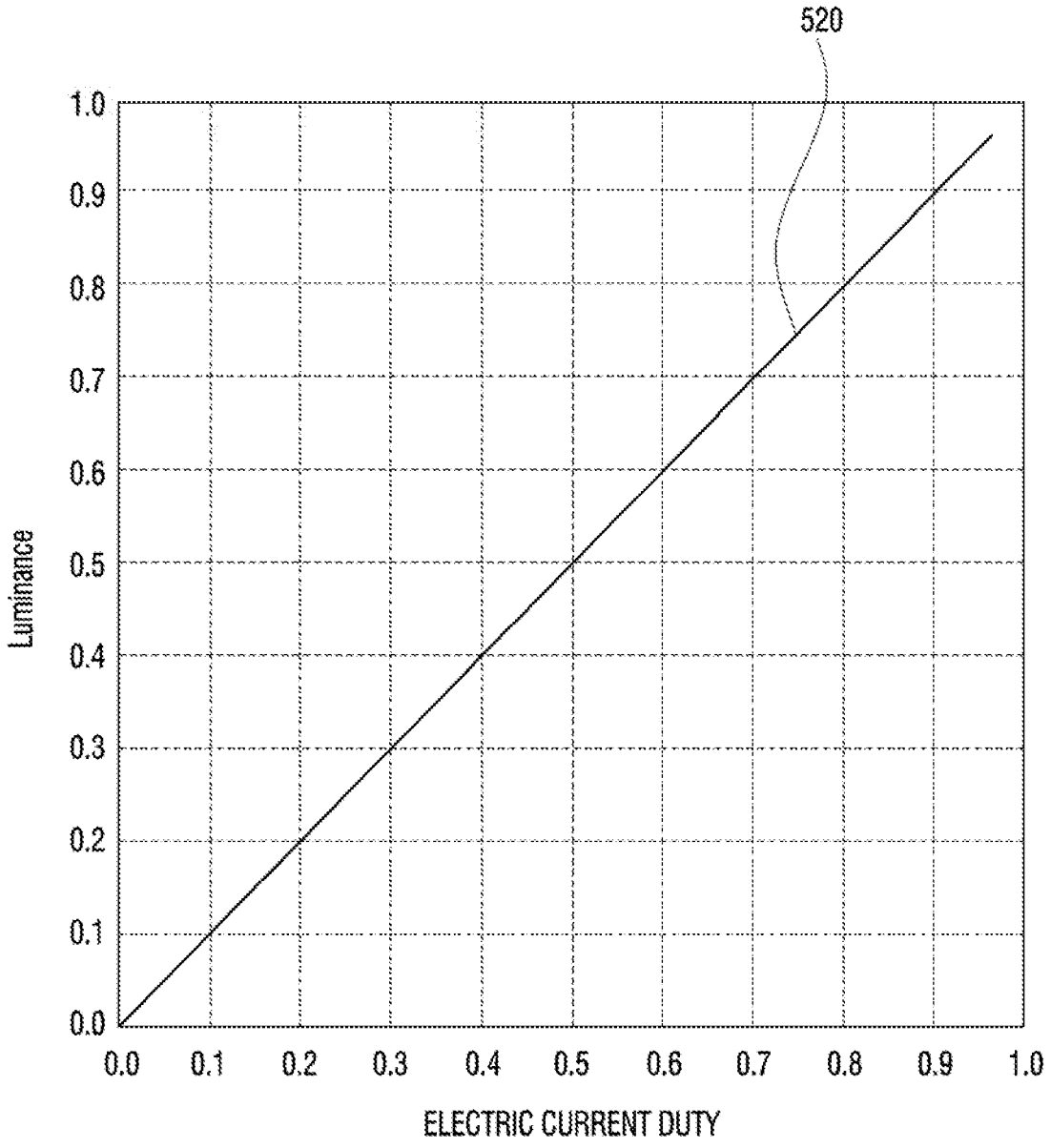
Figure 5C:
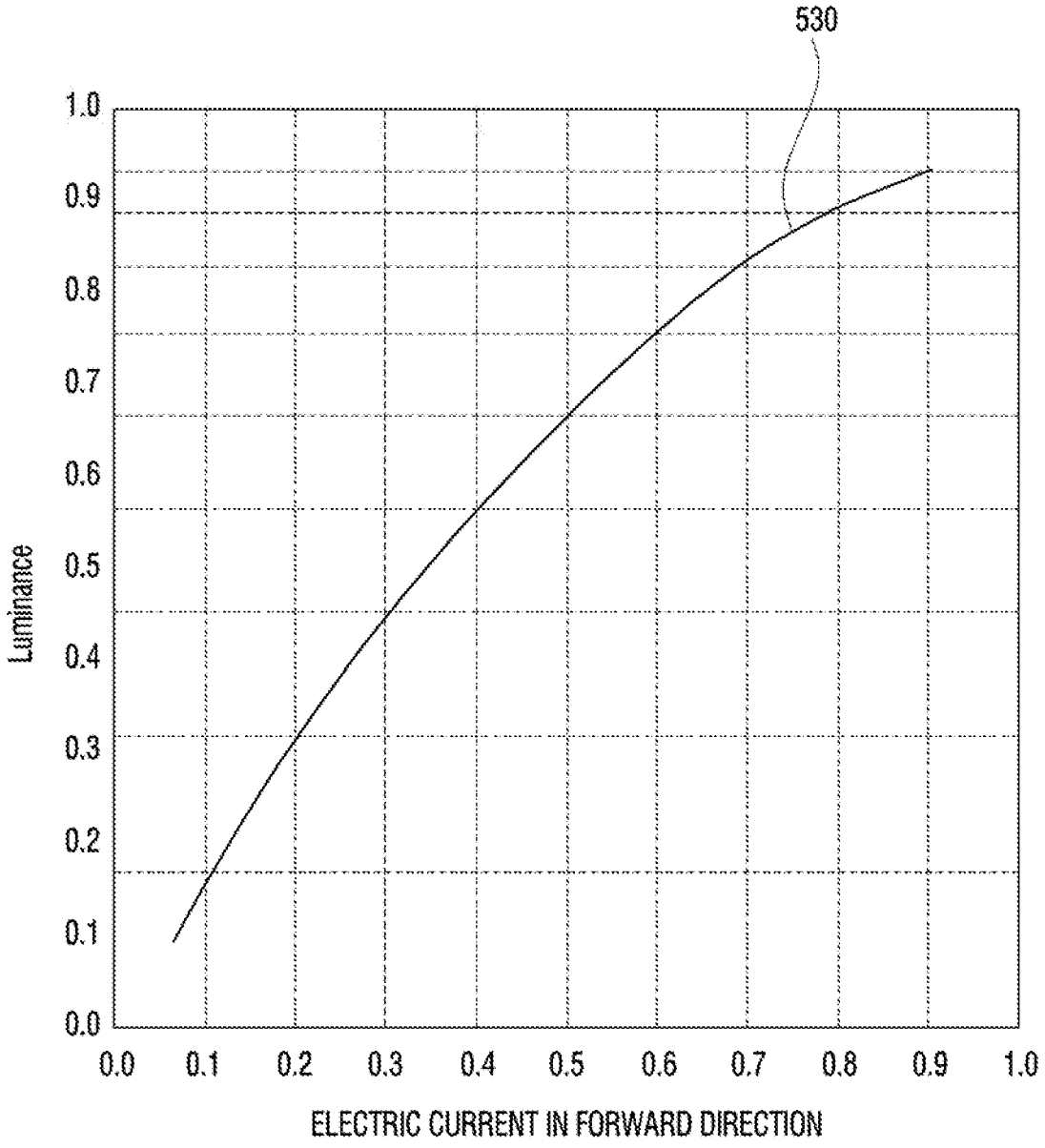

FIGS. 5A to 5C are views illustrating information used to acquire a current value according to an embodiment.

FIG. 5A shows an example of information 510 for a current value corresponding to each current duty. The current value may be calculated by considering power consumption of the electronic device 100, luminance information according to the current duty, and luminance information according to the current value, may be pre-stored in the electronic device 100 or may be received from the outside. Alternatively, algorithms, equations, etc. for calculating the corresponding graph may be pre-stored in the electronic device 100 or may be received from the outside. FIG. 5B illustrates an example of relationship between luminance and current duty, and FIG. 5C illustrates an example of the relationship between luminance and current intensity. Based on a relationship graph as illustrated in FIGS. 5B and 5C, at least one of information about a current value corresponding to each current duty and current gain value corresponding to each current duty (e.g., the graph as illustrated in FIG. 5A) may be acquired.

Figure 6A:
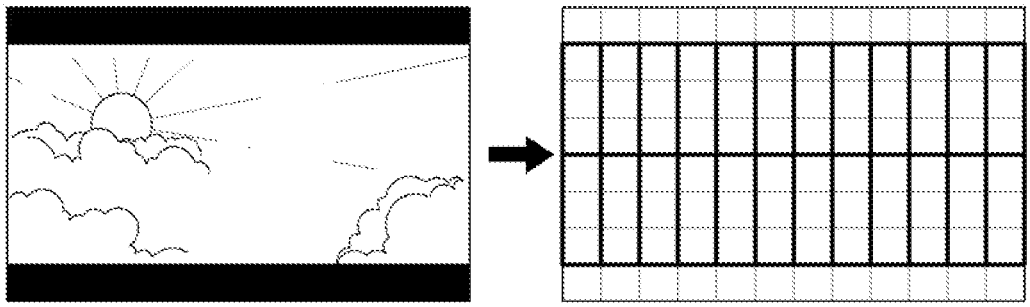
FIGS. 6A to 6C are views illustrating various embodiments that identifies a second dimming block according to an embodiment.
Figure 6B:
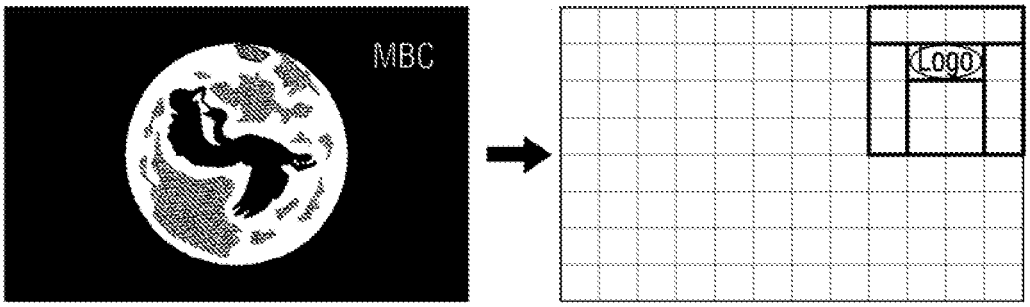
Figure 6C:
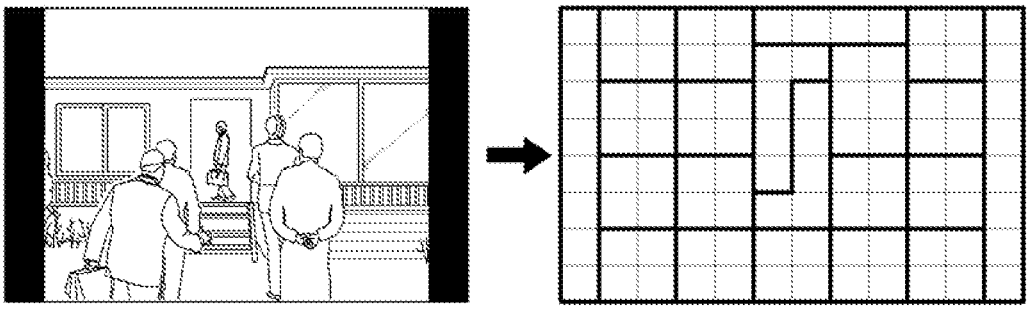

FIGS. 6A to 6C are views illustrating various embodiments that identifies a second dimming block according to an embodiment.

According to an example, when an input image is a letter box image or a pillar box image as illustrated in FIG. 6A, at least one second dimming block may be identified based on a pixel value of an area not including black. Also, an area including black on the upper side and an area including black on the lower side may be identified as a second dimming block, respectively. For example, power consumption may be reduced by applying a relatively low current value to the upper black area and the lower black area than the remaining areas. However, the second dimming block is not distinguished from the letter box (or pillar box) area and boundary areas of the remaining area, so that a luminance value of each area may be prevented from being affected.

According to another example, when a specific content is displayed at a fixed position, such as the logo, as illustrated in FIG. 6B, while identifying the second dimming block, the corresponding area is set as a separate second dimming block so that the luminance of the corresponding area does not have different values.

According to another example, when various grayscale values are included in the input image as illustrated in FIG. 6C, areas having similar grayscales may be identified as the second dimming blocks different from each other. For example, a grayscale range (e.g., high grayscale, grayscale, low grayscale, etc.) of grayscale values included in the input image may be identified, and a second dimming block may be identified for each grayscale range.

Meanwhile, at least some of the configurations performed on the electronic device 100 illustrated in FIGS. 2A and 2B may be performed through an external server (not illustrate). For example, when the electronic device 100 transmits the input image to the server, the server may analyze the input image, perform at least one function among acquiring a current duty of the first dimming block, identifying the second dimming block, acquiring the current duty of the second dimming block, and acquiring the current value of the second dimming block to transmit the acquired information to the electronic device 100. In this case, the electronic device 100 may use the information received from the server as it is, or use it by variously changing it. For example, it may change at least one of the size and number of the second dimming blocks received from the server based on physical characteristics of at least one of the display panel 130 and the backlight unit 140.

Figure 7A:
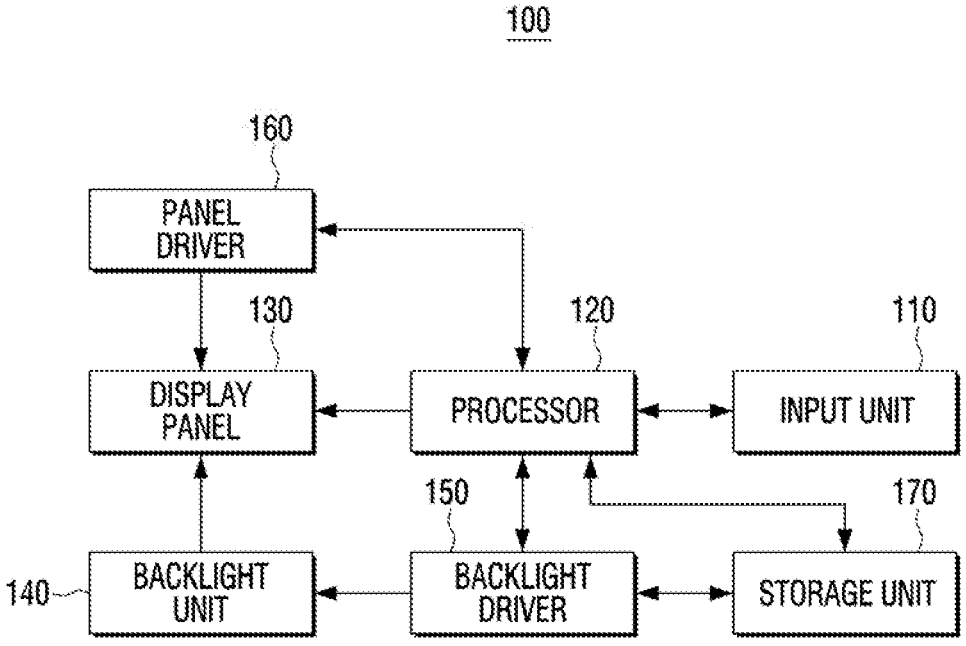
FIGS. 7A and 7B are views illustrating a detailed configuration of an electronic device according to an embodiment.
Figure 7B:
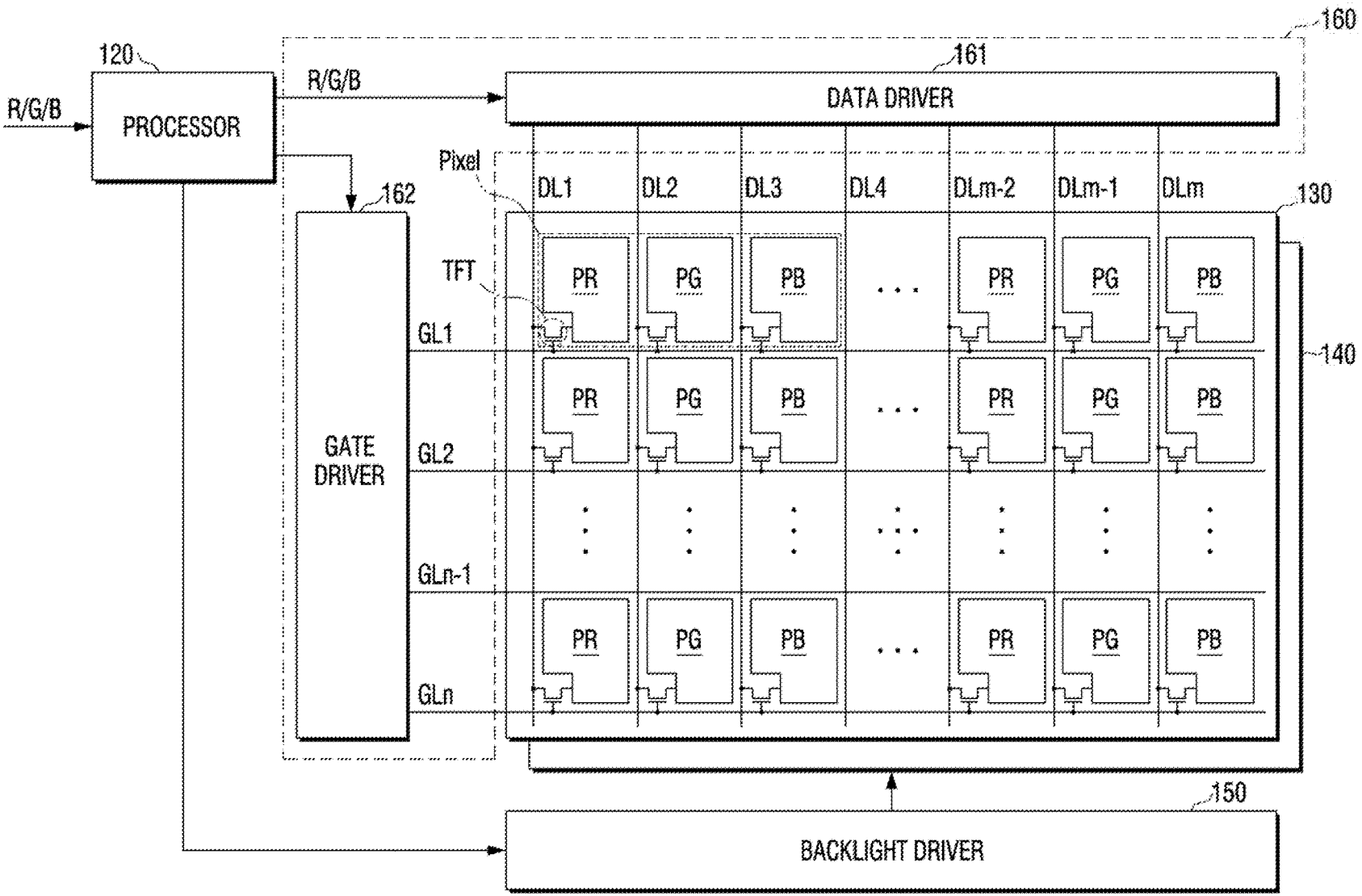

FIGS. 7A and 7B are views illustrating a detailed configuration of an electronic device according to an embodiment.

According to FIG. 7A, the electronic device 100 includes an input unit 110, a processor 120, a display panel 130, a backlight unit 140, a backlight driver 150, a panel driver 160, and a storage unit 170. Among the configurations illustrated in FIG. 7A, detailed descriptions of configurations overlapping with those illustrated in FIG. 2B will be omitted.

The display panel 130 may be formed such that gate lines GL1 to GLn and data lines DL1 to DLm cross each other as illustrated in FIG. 7B, and R, G, and B sub-pixels PR, PG, and PB are formed in an area where the gate lines and the date lines cross each other. Adjacent R, G, and B sub-pixels PR, PG, and PB form one pixel. In other words, each pixel may include an R sub-pixel PR referring to red (R), a G sub-pixel PG referring to green (G), and a B sub-pixel PB referring to blue (B), and realize the color of the subject in three primary colors: red (R), green (G), and blue (B).

When the display panel 130 is implemented as an LCD panel, each sub-pixel PR, PG, and PB may include a pixel electrode and a common electrode, and a light transmittance is changed while a liquid crystal arrangement is changed to an electric field formed by a potential difference between both electrodes. TFTs formed at intersections of the gate lines GL1 to GLn and the data lines DL1 to DLm may response scan pulses from the gate lines GL1 to GLn, respectively, and provide video data from the data lines DL1 to DLm, that is, red (R), green (G), and blue (B) data to the pixel electrodes of each sub-pixel PR, PG, and PB.

The backlight driver 150 may be implemented in a form of including a driver IC for driving the backlight unit 140. According to an embodiment, the driver IC may be implemented with hardware separate from the processor 120. For example, when the light sources included in the backlight unit 140 are implemented as LED elements, the driver IC may be implemented as at least one LED driver that controls a current applied to the LED elements. According to an embodiment, the LED driver may be disposed at a rear end of a power supply (e.g., a switching mode power supply (SMPS)) to receive a voltage from the power supply. However, according to another embodiment, a voltage may be applied from a separate power supply. Alternatively, the SMPS and the LED driver may also be possible to be implemented in the form of an integrated module.

The panel driver 160 may be implemented in a form of including a driver IC for driving the display panel 130. According to an example, the driver IC may be implemented with hardware separate from the processor 120. For example, the panel driver 160 may include a data driver 161 that supplies video data to data lines and a gate driver 162 that supplies scan pulses to gate lines, as illustrated in FIG. 7B.

The data driver 161 is a means for generating a data signal, and receives image data of R/G/B components from the processor 120 (or a timing controller (not illustrated)) to generate a data signal. Also, the data driver 161 may be connected with data lines DL1, DL2, DL3, . . . , DLm of the display panel 130 to apply the generated data signals to the display panel 130.

The gate driver 162 (or scan driver) is a means for generating a gate signal (or scan signal) and is connected to the gate lines GL1, GL2, GL3, . . . , GLn to transmit the gate signal to a specific row of the display panel 130. A pixel where the gate signal is transmitted may receive data signal output from the data driver 161.

In addition, the panel driver 160 may further include a timing controller (not illustrated). The timing controller (not illustrated) may receive an input signal (IS), a horizontal synchronization signal (Hsync), a vertical synchronization signal (Vsync), and a main clock signal (MCLK) from the processor 120, for example, and generate a video data signal, a scan control signal, a data control signal, a light emission control signal, etc. and provide the signals to the display panel 130, the data driver 161, the gate driver 162, or the like.

The storage unit 170 may store various data necessary for operating the electronic device 100.

In particular, the storage unit 170 may store data necessary for the processor 120 to perform various processes. For example, the storage unit may be implemented as an internal memory such as a ROM or RAM included in the processor 120 or may be implemented as a memory separate from the processor 120. In this case, the storage unit 170 may be implemented as a memory embedded in the electronic device 100 according to a data storage purpose, or may be implemented as a detachable memory from the electronic device 100. For example, data for driving the electronic device 100 may be stored in a memory embedded in the electronic device 100, and data for expanding function of the electronic device 100 may be stored in the detachable memory from the electronic device 100. Meanwhile, the memory embedded in the electronic device 100 may be implemented in the form of a non-volatile memory, a volatile memory, a flash memory, a hard disk drive (HDD), a solid state drive (SSD), or the like, and the detachable memory may be implemented as a memory card (e.g., micro SD card, USB memory, etc.), an external memory (e.g., USB memory) connectable to a USB port, or the like may be implemented.

Meanwhile, according to another embodiment, the information described above (e.g., information for acquiring a current duty of the first dimming block, information for acquiring a current value of the second dimming block, or the like) stored in the storage unit 170 are possible to be acquired from an external device not by being stored in the storage unit 170. For example, some information may be received in real time from the external device such as a set-top box, external server, user terminal, or the like.

Figure 8:
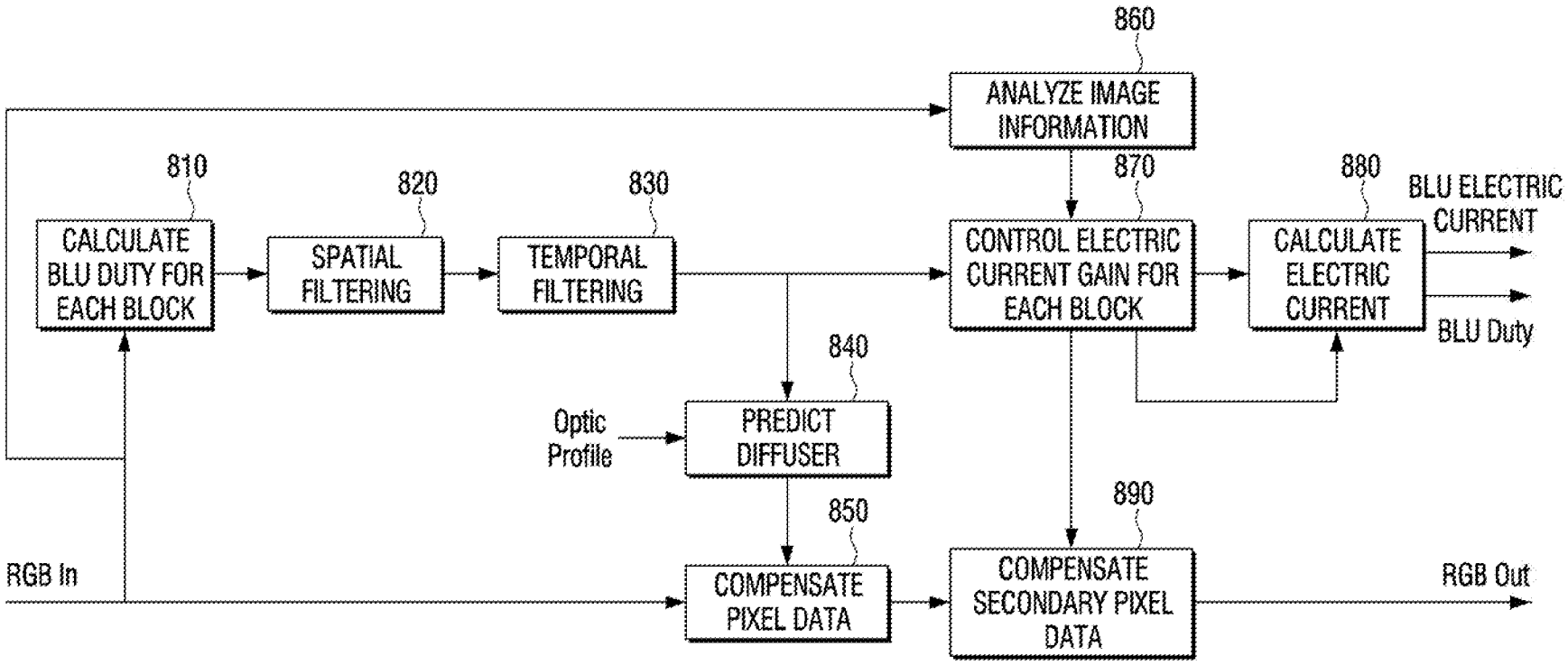
FIG. 8 is a block diagram sequentially illustrating an image processing operation according to an embodiment.

FIG. 8 is a block diagram sequentially illustrating an image processing operation according to an embodiment.

According to an embodiment of the disclosure, the processor 120 calculates a current duty for each first dimming block (810). For example, a current duty for each first dimming block is calculated based on RGB pixel information for each first dimming block.

The processor 120 performs spatial filtering to reduce a dimming difference between each backlight block (820). For example, the difference may be alleviated by adjusting the current duty of the current block with a filtering method that applies a spatial filter having a window of a specific size (e.g., 3×3 size) to the current duty of each of 8 blocks adjacent to the current duty of the current block by giving a specific weight to the current duty.

The processor 120 performs temporal filtering to reduce luminance difference according to a change of the image (830). In general, when performing local dimming, a flicker phenomenon may occur due to a difference in luminance according to the image change. In order to prevent the phenomenon, according to an embodiment of the disclosure, temporal filtering may be performed to smoothly change the luminance of the backlight unit 120 according to the image frame. For example, the processor 120 may compare the N-th dimming data corresponding to the current frame with the N-1-th dimming data corresponding to the previous frame, and perform filtering such that luminance of the backlight unit 140 is slowly changed for a certain time according to the comparison result.

The processor 120 may compensate pixel data based on a light profile of the backlight unit 140. For example, the processor 120 may analyze the light profile of the backlight light source to predict a light diffuser 840 and compensate the pixel data based on the prediction result (850).

The processor 120 may analyze pixel information of the input image (860), calculate a current gain value for each second dimming block, and perform analog dimming (870). For example, the analog dimming may be performed based on the second dimming block in the same method as described with reference to FIGS. 2A to 6C.

Figure 9:
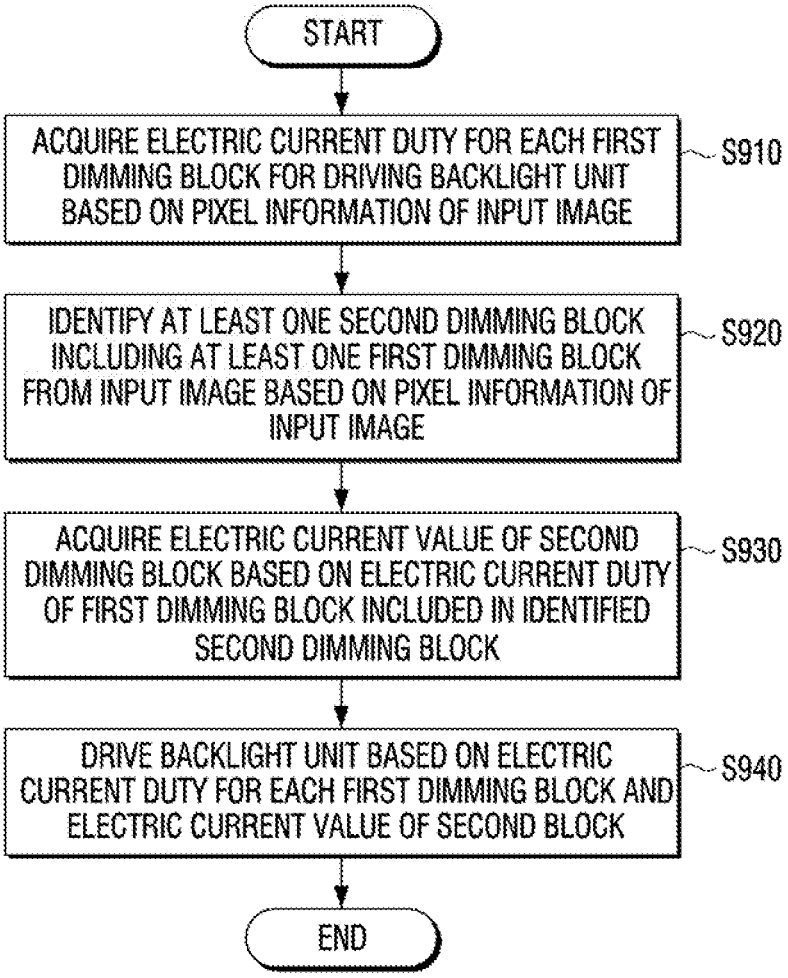
FIG. 9 is a flowchart illustrating a control method of an electronic device according to an embodiment."

FIG. 9 is a flowchart illustrating a control method of an electronic device according to an embodiment of the disclosure.

According to the control method of the electronic device illustrated in FIG. 9, firstly, a current duty for each first dimming block for driving a backlight unit is acquired based on pixel information of an input image (S910). It may be a local dimming block implemented to enable duty control for each block for PWM local dimming of the backlight unit.

At least one second dimming block including at least one first dimming block is identified from the input image based on the pixel information of the input image (S920).

A current value of the second dimming block is acquired based on the current duty of the first dimming block included in the identified second dimming block (S930).

Thereafter, a driving signal for driving the backlight unit is acquired based on the current duty for each first dimming block and the current value of the second dimming block (S940).

In the operation S920, at least one of the size and shape of the second dimming block may be variably identified based on the pixel information of the input image.

In the operation S930, the current value of the second dimming block may be acquired based on at least one of an average duty value, a maximum duty value, a minimum duty value, and an intermediate duty value of at least one first dimming block included in the second dimming block.

In addition, in the operation S930, a current duty corresponding to the second dimming block by applying a predetermined weight to at least one of the maximum duty value, the minimum duty value, and the intermediate duty value of at least one first dimming block included in the second dimming block, and a current value of the second dimming block may be acquired based on the acquired electric current duty.

In the operation S930, the current value corresponding to the current duty of the first dimming block included in the identified second dimming block may be acquired from information on the current value corresponding to each current duty, and the current value of the second dimming block may be acquired based on the acquired electric current value.

In addition, in the operation S930, a gain value according to the current duty of the first dimming block included in the identified second dimming block may be acquired, and the current value of the second dimming block may be acquired by applying the acquired gain value to the predetermined electric current value.

In the operation S920, the input image may be identified as a plurality of areas according to grayscale based on pixel information of the input image, and at least one second dimming block may be identified in each area.

In the operation S920, when the input image includes a black area having a size larger than the predetermined size, the second dimming block may be identified in the remaining areas except the black area.

In addition, in the operation S920, when a logo area is included in the input image, the area including the logo area may be identified as a second dimming block.

According to various embodiments described above, according to various embodiments of the disclosure, a clear image may be provided, power consumption may be reduced, and a black improvement effect may also be improved.

Meanwhile, at least some of the methods according to various embodiments of the disclosure described above may be implemented in an application capable of installing in at least one of an existing display device and an electronic device that provides an image to the existing display device.

At least some of the methods according to various embodiments of the disclosure described above may be implemented only by software upgrade or hardware upgrade of at least one of the existing electronic device and the display device.

At least some of the various embodiments of the disclosure described above may be performed through an embedded server provided in at least one of the electronic device and the display device, or an external server of at least one of the electronic device and the display device.

Various exemplary embodiments described above may be embodied in a recording medium that may be read by a computer or a similar apparatus to the computer by using software, hardware, or a combination thereof In some cases, at least some of the embodiments described herein may be implemented by the processor 120 by itself. In a software configuration, various embodiments described in the specification such as a procedure and a function may be embodied as separate software modules. The software modules may respectively perform one or more functions and operations described in the present specification.

Computer instructions for performing a processing operation of the electronic device 100 according to various embodiments of the disclosure described above may be stored in a non-transitory computer-readable medium. The computer instructions stored in the non-transitory computer readable medium let a specific device to perform a processing operation in the electronic device 100 according to various embodiments described above when executed by a processor of the specific device.

The non-transitory computer readable recording medium refers to a medium that stores data and that can be read by devices. For example, the non-transitory computer-readable medium may be CD, DVD, a hard disc, Blu-ray disc, USB, a memory card, ROM, or the like.

The foregoing exemplary embodiments and advantages are merely exemplary and are not to be construed as limiting the present invention. The present teaching can be readily applied to other types of apparatuses. Also, the description of the exemplary embodiments is intended to be illustrative, and not to limit the scope of the claims, and many alternatives, modifications, and variations will be apparent to those skilled in the art.

What is claimed is:

1. An electronic device comprising:

an input unit; and a processor configured to:

acquire a current duty of a plurality of first dimming blocks, respectively, for driving a backlight unit, based on pixel information of an image input through the input unit;

identify a second dimming block including a first dimming block among the plurality of first dimming blocks in the image, based on the pixel information of the image;

acquire a current value of the second dimming block based on a current duty of the first dimming block included in the second dimming block; and acquire a driving signal for driving the backlight unit, based on the current duty of the plurality of first dimming blocks, respectively, and the current value of the second dimming block.

2. The electronic device as claimed in claim 1, wherein the processor is further configured to variably identify at least one of a size or a shape of the second dimming block based on the pixel information of the image.

3. The electronic device as claimed in claim 1, wherein the processor is further configured to acquire the current value of the second dimming block based on at least one of an average duty value, a maximum duty value, a minimum duty value, or an intermediate duty value of the first dimming block included in the second dimming block.

4. The electronic device as claimed in claim 3, wherein the processor is further configured to acquire a current duty corresponding to the second dimming block by applying a predetermined weight to the at least one of the maximum duty value, the minimum duty value, or the intermediate duty value of the first dimming block included in the second dimming block, and acquire the current value of the second dimming block based on the acquired current duty.

5. The electronic device as claimed in claim 1, further comprising a storage unit configured to store information about a current value corresponding to the current duty of the plurality of first dimming blocks, respectively, wherein the processor is further configured to acquire the current value corresponding to the current duty of the first dimming block included in the second dimming block, and acquire the current value of the second dimming block based on the acquired current value.

6. The electronic device as claimed in claim 1, wherein the processor is further configured to acquire a gain value according to the current duty of the first dimming block included in the second dimming block, and acquire the current value of the second dimming block by applying the gain value to a predetermined current value.

7. The electronic device as claimed in claim 1, wherein the processor is further configured to identify the image as a plurality of areas according to grayscale, and identify at least one second dimming block within each area.

8. The electronic device as claimed in claim 1, wherein the processor is further configured to, based on a black area larger than a predetermined size being included in the image, identify the second dimming block in a remaining area other than the black area.

9. The electronic device as claimed in claim 1, wherein the processor is further configured to, based on a logo area being included in the image, identify the logo area as the second dimming block.

10. The electronic device as claimed in claim 1, further comprising:

a display panel; and the backlight unit, wherein the processor is further configured to drive the backlight unit based on the acquired driving signal.

11. A control method of an electronic device, the control method comprising:

acquiring a current duty of a plurality of first dimming blocks, respectively, for driving a backlight unit based on pixel information of an input image;

identifying a second dimming block including a first dimming block among the plurality of first dimming blocks in the input image based on the pixel information of the input image;

acquiring a current value of the second dimming block based on the current duty of the first dimming block included in the second dimming block; and acquiring a driving signal for driving the backlight unit based on the current duty of the plurality of first dimming blocks, respectively, and the current value of the second dimming block.

12. The control method as claimed in claim 11, wherein the identifying the second dimming block further comprises:

variably identifying at least one of a size or a shape of the second dimming block based on the pixel information of the input image.

13. The control method as claimed in claim 11, wherein the acquiring the current value of the second dimming block further comprises:

acquiring the current value of the second dimming block based on at least one of an average duty value, a maximum duty value, a minimum duty value, or an intermediate duty value of the first dimming block included in the second dimming block.

14. The control method as claimed in claim 13, wherein the acquiring the current value of the second dimming block further comprises:

acquiring the current duty corresponding to the second dimming block by applying a predetermined weight to the at least one of the maximum duty value, the minimum duty value, or the intermediate duty value of the first dimming block included in the second dimming block, and acquiring the current value of the second dimming block based on the acquired current duty.

15. The control method as claimed in claim 11, wherein the acquiring the current value of the second dimming block further comprises:

acquiring the current value corresponding to the current duty of the first dimming block included in the second dimming block, and acquiring the current value of the second dimming block based on the acquired current value.

* * * * *